US007344220B2

(12) United States Patent
Moynihan

(10) Patent No.: US 7,344,220 B2
(45) Date of Patent: Mar. 18, 2008

(54) INK JET PRINTING APPARATUS HAVING NON-CONTACT PRINT HEAD MAINTENANCE STATION

(75) Inventor: Edward R. Moynihan, Plainfield, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 212 days.

(21) Appl. No.: 11/043,841

(22) Filed: Jan. 25, 2005

(65) Prior Publication Data

US 2006/0164485 A1 Jul. 27, 2006

(51) Int. Cl.
*B41J 2/165* (2006.01)

(52) U.S. Cl. ..... 347/28; 347/32

(58) Field of Classification Search ..... 347/28, 347/32

See application file for complete search history.

(56) References Cited

U.S. PATENT DOCUMENTS

| | | | | |
|---|---|---|---|---|
| 5,371,531 | A * | 12/1994 | Rezanka et al. | 347/43 |
| 6,578,945 | B2 * | 6/2003 | Hashi et al. | 347/22 |
| 6,695,429 | B2 * | 2/2004 | Barinaga | 347/28 |
| 2002/0126174 | A1 * | 9/2002 | Sharma et al. | 347/28 |

* cited by examiner

*Primary Examiner*—Stephen Meier
*Assistant Examiner*—Ly T. Tran
(74) *Attorney, Agent, or Firm*—Fish & Richardson P.C.

(57) ABSTRACT

An ink jet printing system comprises an ink jet print head including one or more nozzles for ejecting ink drops. A substrate is adjacent to the nozzles. The substrate is adapted to be wetted by a solvent and to produce a solvent vapor in the vicinity of the nozzles.

34 Claims, 2 Drawing Sheets

INK JET PRINTING APPARATUS HAVING NON-CONTACT PRINT HEAD MAINTENANCE STATION

TECHNICAL FIELD

This application relates to the field of ink jet printing.

BACKGROUND

Ink jet printing is a non-impact method that produces droplets of ink that are deposited on a substrate such as paper or transparent film in response to an electronic digital signal.

Ink jet printing systems generally are of two types: continuous stream and drop-on-demand. In continuous stream ink jet systems, ink is emitted in a continuous stream under pressure through at least one orifice or nozzle. Multiple orifices or nozzles also may be used to increase imaging speed and throughput. The ink is ejected out of orifices and perturbed, causing it to break up into droplets at a fixed distance from the orifice. At the break-up point, the electrically charged ink droplets are passed through an applied electrode which is controlled and switched on and off in accordance with digital data signals. Charged ink droplets are passed through a controllable electric field, which adjusts the trajectory of each droplet in order to direct it to either a gutter for ink deletion and recirculation or a specific location on a recording medium to create images. The image creation is controlled by electronic signals.

In drop-on-demand systems, a droplet is ejected from an orifice directly to a recording medium by pressure created by, for example, a piezoelectric device, an acoustic device, or a thermal device controlled in accordance with digital data signals. An ink droplet is not generated and ejected through the nozzles of an imaging device unless it is to be placed on the recording medium.

One issue for print heads running with volatile inks is the drying of inks in the ink nozzles. The capping of print heads is commonly used to prevent ink drying in the nozzles.

SUMMARY

In one aspect, the present invention relates to an ink jet printing system, including an ink jet print head comprising one or more nozzles through which ink drops can be ejected and a substrate that is adapted to be wetted by a solvent and to produce a solvent vapor in the vicinity of the nozzles.

In another aspect, the present invention relates to a fluid delivery system including a fluid delivery head comprising one or more nozzles that are configured to dispose a fluid and a substrate that is adapted to be wetted by a solvent and to produce a solvent vapor in the vicinity of the nozzles.

In still another aspect, the present invention relates to a method for ink jet printing. The method includes providing an ink jet print head comprising one or more nozzles that are adapted to eject ink drops, wetting a substrate with a solvent to produce a solvent vapor and causing a relative movement between the ink jet print head and the substrate such that the nozzles are adjacent to the substrate and are in the vicinity of the solvent vapor.

Implementations of the system may include one or more of the following. An ink jet printing system includes an ink jet print head comprising one or more nozzles through which ink drops can be ejected, and a substrate adjacent to the nozzles, wherein the substrate is adapted to be wetted by a solvent and to produce a solvent vapor in the surrounding of the nozzles. The ink jet printing system can further comprise a nozzle plate that comprises the one or more nozzles and a fluid conduit that supplies an ink fluid to the nozzles. The surface of the substrate can be substantially parallel to the nozzle plate. The surface of the substrate and the nozzle plate can be separated by a distance not more than 10 millimeter. The surface of the substrate and the nozzle plate can be separated by a distance not more than 5 millimeter. The surface of the substrate and the nozzle plate can be separated by a distance not more than 2 millimeter. The ink jet printing system can further comprise a mechanism that can cause the relative movement between the print head and the substrate. The surface of the substrate and the nozzles can be at least partially enclosed. The nozzles can be capped in an enclosure. The surface of the substrate and the nozzles can be capped in the same enclosure. The surface of the substrate can be heated. The solvent vapor can condense on the surfaces in or around the nozzles. The condensed solvent is recovered or recycled. The substrate can include porous material that can absorb the solvent. The ink jet printing system can further comprise a solvent container that is capable of supplying solvent to the substrate. The solvent can comprise an ingredient of the ink. The solvent comprises one or more evaporation inhibitors. The ink jet print head and the substrate can be held stationary relative to each other. The ink jet printing system can further comprise a receiver that is transported between the ink jet print head and the substrate to receive ink drops from the nozzles.

Implementations of the system may include one or more of the following. A method for ink jet printing comprises providing an ink jet print head comprising one or more nozzles, wetting a substrate with a solvent to produce a solvent vapor, and placing the substrate adjacent to the nozzles such that the solvent vapor surrounds the nozzles. The method can further comprise supplying an ink fluid to the nozzles. The method can further comprise supplying the solvent to the substrate. The method can further comprise a nozzle plate comprising the one or more nozzles. The surface of the substrate can be substantially parallel to the face of the nozzle plate. The surface of the substrate and the nozzle plate can be separated by a distance not more than 10 millimeter. The surface of the substrate and the nozzle plate can be separated by a distance not more than 5 millimeter. The surface of the substrate and the nozzle plate can be separated by a distance not more than 2 millimeter. The method can further comprise causing the relative movement between the print head and the substrate. The surface of the substrate and the nozzles are at least partially enclosed. The method can further comprise capping the nozzles in an enclosure. The surface of the substrate and the nozzles can be capped in the same enclosure. The method can further comprise heating at least a portion of the substrate. The method can further comprise condensing the solvent vapor on the surfaces inside or around the nozzles. The method can further comprise recovering or recycling the condensed solvent. The substrate can include porous material that can absorb the solvent. The method can further comprise providing the solvent to the substrate, and controlling the flow rate of the solvent provided to the substrate. The solvent can comprise an ingredient of the ink. The solvent can comprise one or more evaporation inhibitors. The method can further comprise cleaning the nozzles in the print head. The method can further comprise transporting a receiver to receive ink drops from the ink jet print head. The receiver can be transported through a gap between the ink jet print head and the substrate.

Embodiments may include one or more of the following advantages. The disclosed ink jet system provides effective arrangements to prevent the ink drying in the ink nozzles in the nozzle plate. The nozzles are kept wet in a solvent vapor without requiring the nozzles or the nozzle plate to be in contact with a physical object. The ink meniscus and ink content can be kept intact in the nozzles. The print heads can more quickly switch from an idle state to a printing mode compared to the print heads maintained by a capping system. The disclosed system and method do not require complicated designs for sealing a cap to a nozzle plate. The disclosed system and method are beneficial for maintaining ink jet print heads in a period of non-printing (idle) time.

The details of one or more embodiments are set forth in the accompanying drawing and in the description below. Other features, objects, and advantages of the invention will become apparent from the description and drawings, and from the claims.

DETAILED DESCRIPTION

Figure 1:
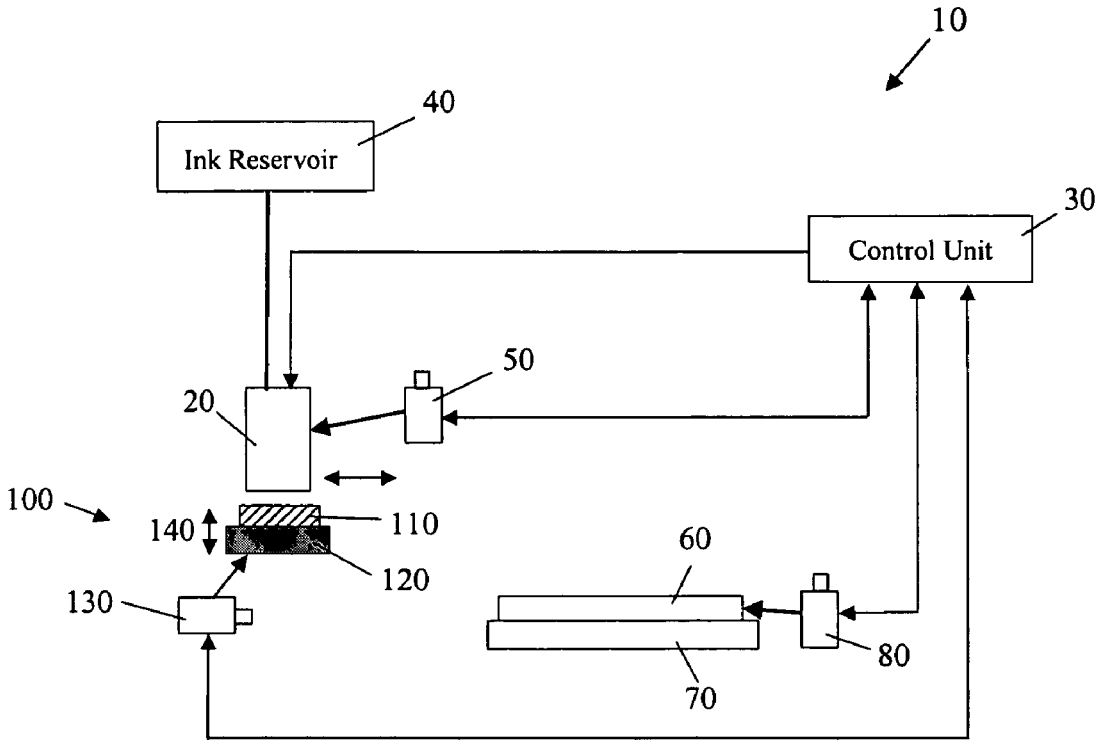
FIG. 1 illustrates an ink jet printing system having a non-contact print head maintenance station.

FIG. 1 shows an ink jet printing system 10 including an ink jet print head 20, controller unit 30 that provides image data and other digital data to the ink jet print head 20, and ink reservoir 40 for supplying ink through a fluid conduit to the ink jet print head 20.

The ink jet print head 20 can be transported by a head transport mechanism 50 to scan above an ink receiver 60 along a first direction. The ink receiver 60 is placed on a platen 70. The ink receiver 60 can be moved in a second direction by receiver transport mechanism 80. The head transport mechanism 50 and the receiver transport mechanism 80 are controlled by the controller 30.

Ink jet print heads running with volatile inks such as the commonly used solvent and aqueous inks must be carefully managed to prevent the drying of inks in the ink nozzles. The ink jet print head is commonly capped to prevent ink drying in the nozzles if the print head is idle for a long period of time. Within the small enclosed space under the cap, the solvent vapor concentration can rise and approach the saturated condition. There are, however, several disadvantages related to capping. One drawback is that the mechanical design details can be very challenging as the nozzle plate must be held in physical contact with a sealing element to prevent leakage of vapor. This can be particularly difficult with large areas of wetted nozzle plate. Another drawback is that a capped nozzle plate is generally not able to immediately start printing. It usually needs to be wiped to clean off the residue of ink around the seal area.

In the ink jet printing system 10 shown in FIG. 1, the head transport mechanism 50 can transport the ink jet print head 20 to a print head maintenance station 100. The print head maintenance station 100 includes a substrate 110 that is wetted by a solvent that is supplied by a solvent container 120. The wetted substrate is capable of producing a solvent vapor in the environment surrounding the ink nozzles of the ink jet print head 20 in the maintenance station 100. The substrate 110 can be moved by a mechanism 130 along direction 140 such that the surface of the substrate 110 can come to be adjacent to the ink nozzles. The substrate 110 is not required to come in contact with the nozzle plate of the ink jet print head 20.

Figure 2:
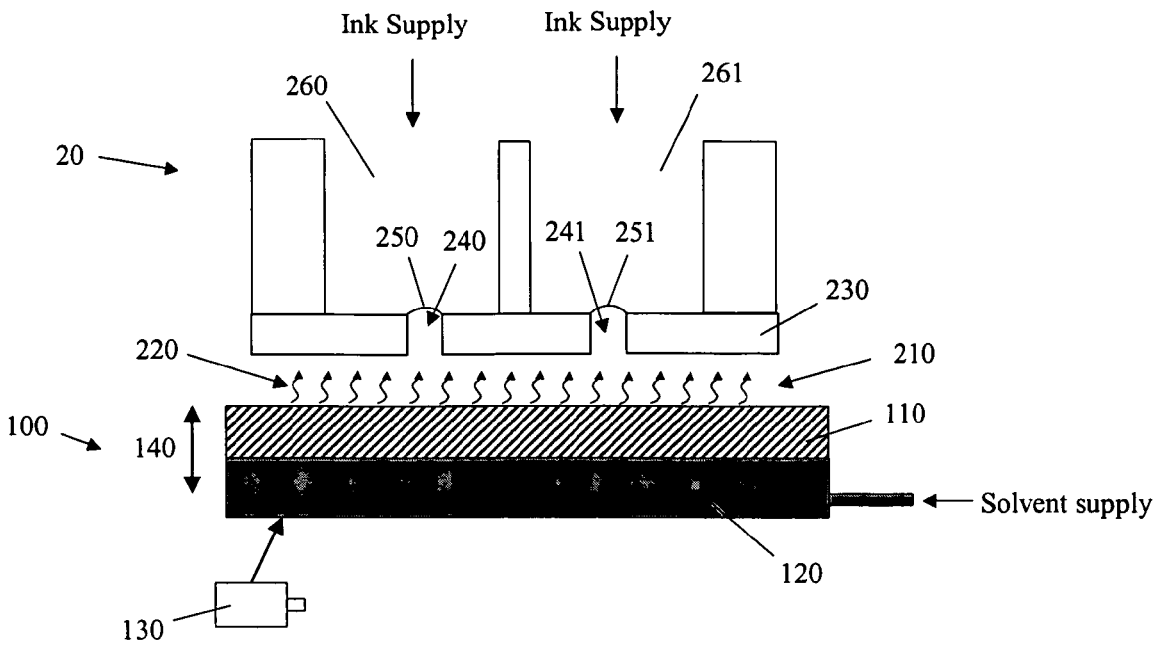
FIG. 2 illustrates details of the print head maintenance station in FIG. 1.

FIG. 2 shows a detailed diagram of the relative positions of the print head maintenance station 100 and the ink jet print head 20. The ink jet print head 20 includes a nozzle plate 230 and a plurality of ink nozzles 240, 241 in the nozzle plate. Each ink nozzle 240,241 is respectively in fluid connection with one of the ink conduits 260, 261. The ink fluid is supplied from the ink conduits 260, 261 to the ink nozzles 240, 241 under a negative pressure. Ink meniscus 250, 251 are formed in the ink nozzles 240, 241. An ink ejection actuator (not shown) can create pressure in the ink fluid in the ink conduit 260,261 to cause the ejection of ink drops out of ink nozzles 240,241.

The ink jet print head 20 is moved by the head transport mechanism 50 over the substrate 110. The substrate 110 can be moved by a mechanism 130 in the direction 140 such that the surface of the substrate 110 comes to close proximity to the nozzle plate 230. However, the surface of the substrate 110 is not in contact with the nozzle plate 230. The substrate 110 is separated from the nozzle plate 230 by a gap 210 that is controlled by mechanism 130. The widths of the substrate 110 are large enough to cover the area of the ink nozzles 240, 241 in the nozzle plate 230. The gap 210 is smaller, preferably much smaller, than the widths of the nozzle plate 230 or the widths of the substrate 110. For example, the gap 230 may be not more than 10 millimeter. In another example, the gap 230 may be not more than 5 millimeter or 2 millimeter.

In another embodiment, the ink jet print head and the substrate (i.e. the solvent wick) are both held stationary. The receiver is transported through the gap between the ink jet print heads and the substrate for printing. The printing may sometimes include a single pass. The disclosed system provides print head maintenance without moving the print heads between the printing mode and the idle mode. Operation duty cycle and thus system throughput can be significantly increased.

The surface of the substrate 110 is wetted with a solvent that can prevent inks in the nozzles 240,241 from drying. The solvent can evaporate from the surface of the substrate 110 to produce a solvent vapor in the surrounding of the nozzles 240,241. The substrate 110 can include different materials or structures that are effective at absorbing solvent to create a wet surface facing the nozzle plate 230. For example, the substrate 110 can be a wick plate made of a porous sintered material that can effectively absorb the solvent. In another example, the substrate 110 can be coated with a fabric such as "Pro-Wipe 880" polypropylene wipe available from Berkshire Corp.

The solvent is supplied to the substrate 110 from the solvent container 120 that further receives solvent from an external source. The solvent evaporates from the surface of the substrate 110 and produces solvent vapor 220 in the gap 210. Because the gap 210 is smaller than the lateral dimensions of the substrate 110 and the nozzle plate 230, solvent vapor 220 can be maintained in the gap 210 for a period of time to produce a relative vapor concentration close to saturation. The relative high concentration of solvent vapor 220 in the gap 210 can significantly reduce or stop the evaporation at the ink meniscus 250,251, therefore inhibiting or preventing ink drying in the ink nozzles 240, 241.

The concentration level of the solvent vapor 220 in the gap 210 can be maintained by optimizing several parameters. The surface area of the substrate 110 preferably covers all the nozzles in the nozzle plate 230. The gap 210 is smaller than the lateral dimensions of the substrate 110 to keep the solvent vapor 220 in the gap for longer period of time. In addition, the surface of the substrate 110 and the face of the nozzle plate 230 can be partially or completely enclosed around the gap 220 to keep the solvent vapor 220 inside the enclosure. The enclosure can cap both the nozzle plate 230 and the substrate 110 together so that the solvent vapor 220 is at least partially kept inside the enclosure.

The flow rate of the solvent vapor 220 through the gap 210 can be controlled. For example, evaporation inhibitors such as glycols can be added to the aqueous solvents to modify the rate of solvent evaporation from the substrate 110. The rate of solvent supply to the solvent container 120 can also be controlled. The flow rate of the solvent to the substrate 110 can also be controlled by selecting materials having different wicking power for the substrate 110, and controlling the rate of solvent supply to solvent container 120 and the rate of solvent transfer from solvent container 120 to the substrate 110.

In another embodiment, the substrate can be heated to an elevated temperature. The nozzle plate 230 is kept at a lower temperature than the substrate 110. The solvent vapor 220 evaporated to the gap 210 can condense on the nozzle plate 230 including the internal walls or the exit rims of the ink nozzles 240, 241. The surfaces in and around the ink nozzles 240, 241 are kept wet. The condensed solvent can be subsequently recovered or recycled back into the solvent container 120.

The system and method described can also be combined with other cleaning techniques. Before or after a period of non-contact maintenance by solvent vapor, the print head nozzle plate can be wiped. The ink nozzles can be purged. In another embodiment, the ink jet print head can be submerged in the solvent in a container to wet the nozzle plate to prevent the drying in the nozzles. To prevent solvent from flowing into the print heads due to the negative pressure applied at the meniscus, the ink supply line to the ink nozzles is closed off. The print heads may be purged after "dipping" before printing operations. In yet another embodiment, the nozzle plate is brought in light contact with a clean wipe or a clean cloth that has been wetted by an appropriate solvent. The system can be controlled such that solvent absorbed in the clean wipe or the clean cloth does not wick into the nozzles. The evaporation loss can be reduced further by wetting the clean wipe or the clean cloth with some ink.

The above described system and methods provide simple, effective and efficient means for preventing ink drying in ink nozzles. The described system and methods do not require complicated designs for sealing the nozzle plate as in a capped system. Printing can be started quickly after idle time without the need of moving a capping mechanism or cleaning the nozzle plate. In certain embodiments, the print heads and the solvent wick substrate are held stationary to each other. System duty cycle is further improved by saving the time to transport the print heads to a maintenance station.

Ink types compatible with the ink jet printing system described include water-based inks, solvent-based inks, and hot melt inks. The colorants in the inks can comprise dye or pigment. Furthermore, the ink jet printing system disclosed is also compatible with delivering other fluids such as polymer solutions, gel solutions, solutions containing particles or low molecular-weight molecules, which may or may not include any colorant. The solvent may include an ingredient of the ink fluid. For example, the solvent can be the main solvent that dissolves dyes or suspends pigments in the ink fluid such that the solvent vapor from the substrate will not change the ingredient in the ink fluids.

What is claimed is:

1. An ink jet printing system, comprising:

an ink jet print head comprising one or more nozzles through which ink drops can be ejected; and a substrate that is adapted to be wetted by a solvent and to produce a solvent vapor in the vicinity of the nozzles, wherein the ink jet print head and substrate are configured so that when the substrate is wetted with the solvent, the solvent vapor is in a gap between the nozzles and the substrate and the gap is maintained between the nozzles and the substrate.

2. The ink jet printing system of claim 1, further comprising a mechanism that can cause a relative movement between the print head and the substrate to bring the substrate adjacent to the nozzles.

3. The ink jet printing system of claim 2, further comprising an enclosure that at least partially encloses the surface of the substrate and the nozzles when the mechanism brings the substrate adjacent the nozzles.

4. The ink jet printing system of claim 2, wherein the mechanism is configured to position the surface of the substrate within 10 millimeters of the nozzle plate.

5. The ink jet printing system of claim 2, wherein the mechanism is configured to position the surface of the substrate within 5 millimeters of the nozzle plate.

6. The ink jet printing system of claim 2, wherein the mechanism is configured to position the surface of the substrate within 2 millimeters of the nozzle plate.

7. The ink jet printing system of claim 1, further comprising:

a nozzle plate that comprises the one or more nozzles; and a fluid conduit that supplies an ink fluid to the nozzles.

8. The ink jet printing system of claim 7, wherein the surface of the substrate is substantially parallel to the nozzle plate.

9. The ink jet printing system of claim 1, further comprising a heater to heat the surface of the substrate.

10. The ink jet printing system of claim 1, wherein the substrate includes a porous material capable of absorbing the solvent.

11. The ink jet printing system of claim 1, further comprising a solvent container to supply solvent to the substrate.

12. The ink jet printing system of claim 1, wherein the solvent comprises an ingredient of the ink or an evaporation inhibitor.

13. The ink jet printing system of claim 1. wherein the gap is maintained during an idle mode.

14. The ink jet printing system of claim 1, wherein the solvent vapor prevents ink from drying in the nozzles.

15. The ink jet printing system of claim 1, wherein the solvent vapor in the gap has a concentration close to saturation.

16. A fluid delivery system, comprising:

a fluid delivery head comprising one or more nozzles that are configured to dispose a fluid; and a substrate that is adapted to be wetted by a solvent and to produce a solvent vapor in the surrounding of the nozzles, wherein the fluid delivery head and substrate are configured so that when the substrate is wetted with the solvent, the solvent vapor is in a gap between the nozzles and the substrate and the gap is maintained between the nozzles and the substrate.

17. The fluid delivery system of claim 16, wherein the fluid delivery head includes an ink jet print head.

18. The fluid delivery system of claim 16, further comprising:

a mechanism that can cause a relative movement between the fluid delivery head and the substrate to bring the substrate adjacent to the nozzles.

19. The fluid delivery system of claim 16, wherein the gap is maintained during an idle mode.

20. The fluid delivery system of claim 16, wherein the solvent vapor prevents fluid from drying in the nozzles.

21. The fluid delivery system of claim 16, wherein the solvent vapor in the gap has a concentration close to saturation.

22. A method for ink jet printing, comprising:

providing an ink jet print head comprising one or more nozzles that are adapted to eject ink drops;

wetting a substrate with a solvent to produce a solvent vapor;

causing a relative movement between the ink jet print head and the substrate such that the nozzles and the substrate are separated by a gap; and maintaining the gap between the nozzles and the substrate while the substrate produces the solvent vapor in the cap.

23. The method of claim 22, further comprising:

supplying an ink fluid to the nozzles; and supplying the solvent to the substrate.

24. The method of claim 22, further comprising positioning a nozzle plate comprising the one or more nozzles substantially parallel to the face of the nozzle plate.

25. The method of claim 24, wherein positioning includes positioning the surface of the substrate within 10 millimeters of the nozzle plate.

26. The method of claim 22, further comprising transporting an ink receiver through the gap between the nozzles and the substrate such that the ink receiver can receive ink drops ejected from the nozzles.

27. The method of claim 22, further comprising at least partially enclosing the surface of the substrate and the nozzles.

28. The method of claim 22, further comprising enclosing the surface of the substrate and the nozzles at least partially in the same enclosure.

29. The method of claim 22, further comprising heating at least a portion of the substrate.

30. The method of claim 22, further comprising condensing the solvent vapor on the surfaces inside or around the nozzles.

31. The method of claim 30, further comprising recovering or recycling the condensed solvent.

32. The method of claim 22, further comprising:

supplying the solvent to the substrate; and controlling the flow rate of the solvent provided to the substrate.

33. The method of claim 22, wherein the gap is maintained during an idle mode.

34. The method of claim 22, wherein the solvent vapor in the gap has a concentration close to saturation.

* * * * *